United States Patent [19]

Kirchoff

[11] 4,110,574

[45] Aug. 29, 1978

[54] SUB-MINIATURE, TWO POSITION DOUBLE POLE SWITCH

[75] Inventor: Francis D. Kirchoff, Waban, Mass.

[73] Assignee: Alco Electronic Products, Inc., North Andover, Mass.

[21] Appl. No.: 782,992

[22] Filed: Mar. 30, 1977

[51] Int. Cl.[2] ..... H01H 13/28; H01H 21/40

[52] U.S. Cl. ..... 200/67 G; 200/6 R; 200/244

[58] Field of Search ..... 200/67 G, 67 R, 67 DB, 200/68, 6 A, 6 R, 6 B, 6 BA, 6 BB, 6 C, 244

[56] References Cited

U.S. PATENT DOCUMENTS

| | | | |
|---|---|---|---|
| 1,912,623 | 6/1933 | Douglas | 200/67 G X |
| 2,027,538 | 1/1936 | Krieger | 200/67 G X |
| 2,808,482 | 10/1957 | Zanichkowsky et al. | 200/6 A X |
| 3,329,784 | 7/1967 | Rogero | 200/68 X |
| 3,454,733 | 7/1969 | Sanford et al. | 200/67 G |
| 3,499,211 | 3/1970 | Dubuc | 200/262 X |
| 3,694,598 | 9/1972 | Nishikawa et al. | 200/67 G |

FOREIGN PATENT DOCUMENTS

| | | | |
|---|---|---|---|
| 789,825 | 1/1958 | United Kingdom | 200/6 A |
| 986,605 | 3/1965 | United Kingdom | 200/67 G |

*Primary Examiner*—Robert S. Ward, Jr.
*Attorney, Agent, or Firm*—Pearson & Pearson

[57] ABSTRACT

A sub-miniature, two position, double pole switch has flat, terminals of rectangular cross section with projecting portions, bent at right angles to the portions inside the case, and having blades of reduced dimensions for insertion in the circular apertures of a modular printed circuit board. The inner portions of the flat terminals, and the dual rockers are separated by an insulator member having an elongated tongue groove for slidably receiving a tongue on the insulated tip of the spring pressed handle. The tongue and groove means prevents arcing, twisting and uneven closing of the switch.

10 Claims, 9 Drawing Figures.

30
36
37
35
34
65
53
51
56
43
59
44
55
58
38
39
54
57
41
42

7
7
5
5
30
35
34
36
75
73
77
72
76
48
65
71
64
46
33
67
62
61
38
55
58
86
85
87
39
47
68
69
45
63

37
35
75
34
36
30
66
49
51
41
46
38
43
74
33
73
52
53
42
86
85
87
39
44

SUB-MINIATURE, TWO POSITION DOUBLE POLE SWITCH

BACKGROUND OF THE INVENTION

In conventional switches of the double pole, two position type, where size and dimensions are not especially critical, the problems of arcing between the dual rockers, within the case, and the problems of rocker twisting, uneven closing, etc. do not normally occur.

It has been found that in miniature switches, used in electronic circuitry, and in sub-miniature switches, which are of even smaller size, the parts, such as the plungers, plunger tips, rockers, terminals and even the switch case are so tiny that they not only are most difficult to machine, shape and install but they may tend to twist in use and cause uneven closing of the circuits. In addition the double poles and dual rockers are so close to each other that cross arcing may occur within the sub-miniature switch case.

It has heretofore been proposed in see-saw switches of the push button type to provide flat metal terminals which are straight and to provide an upstanding insulative wall, or walls, in the space between the dual see-saws as in U.S. Pat. No. 3,694,598 to Nishikawa et al of Sept. 26, 1972.

However in the tiny, sub-miniature switches of the instant invention space must be conserved and there is no room for the dual spring, pressed pushing rods, complicated pushing rod carrier, spring latches and other parts of such see-saw switches.

SUMMARY OF THE INVENTION

In this invention, the switch is termed sub-miniature, or tiny, because the generally cubical casing has outside dimensions of about one quarter of an inch in heighth, depth and width, and yet contains two position, double poles mechanism. Actuation is accomplished within the case by a single, elongated, toggle handle projecting well above the case for easy grasping but having a simple, wide insulated tip within the casing riding on both of the spaced apart rockers.

To form a barrier against cross arcing between the rockers an insulated member extends above and below the level of the double poles in the space between the rockers in the form of a pair of upstanding walls defining an open tongue groove. An insulated tongue depends integrally from the wide, spring pressed tip of the handle to assure that the two, integral contact portions of the tip do not twist the rockers when shifting the switch from one position to the other. Thus uneven closing of the switch circuits is avoided.

The double poles of the two position switch are formed of flat plate-like metal bent at right angles in the portion projecting from the case, and having terminal blades of reduced dimension, rectangular cross section with a shoulder forming a stop when the blades are inserted in the apertures of a modular printed circuit board. Similar blades project from the casing wall to enter other apertures of the modular board for added support for the switch thereon. Thus not only do six terminal blades enter apertures in the board but two additional non conductive blades are provided to assure no dislodgement.

DESCRIPTION OF THE PREFERRED EMBODIMENT

Figure 1:
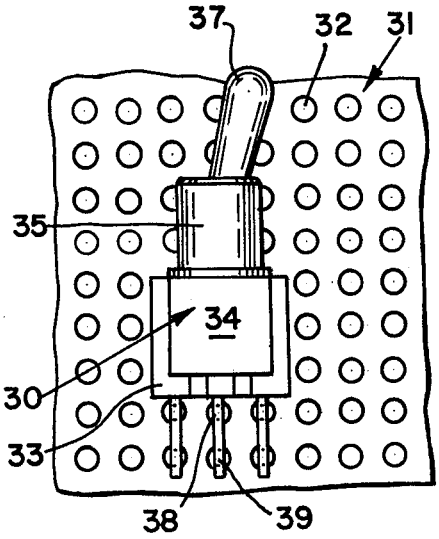
FIG. 1 is a front view of a modular circuit board with a switch of the invention mounted thereon.

As shown in the drawings, on a much enlarged scale about eight times actual size, the sub-miniature, two position, double pole switch 30 of the invention is designed for use on a modular printed circuit board such as at 31, the board 31 having spaced circular apertures 32 thereon each about one twentieth of an inch in diameter.

The case 33 of switch 30 may be about one quarter inch in width, depth and length and of insulative plastic, there being a metal cover 34 and a metal upstanding cylindrical portion 35, the two together forming a frame assembly 36 and therebeing an elongated toggle handle 37.

As shown in FIGS. 1–3 and 5–9 the double pole, two position switch 30 includes six conductive terminals, the central pair 38 and 39 and two outer pairs 41 and 42 and 43 and 44, each formed of flat, plate-like conductive metal of thin, generally rectangular cross section. The inner portions 45 and 46 of the central terminals 38 and 39, within the case, form the fulcrum for the two rockers 47 and 48, as the rockers move from one position in conductive contact with the inner portions 49 and 51 of one pair of outer terminals 41 and 42 to a second position in conductive contact with the inner portions 52 and 53 of the other pair of outer terminals 43 and 44. It will be seen that the inner terminal tips of the inner portions of the outer terminals are in the path of the rockers to close circuits through the switches.

Figure 2:
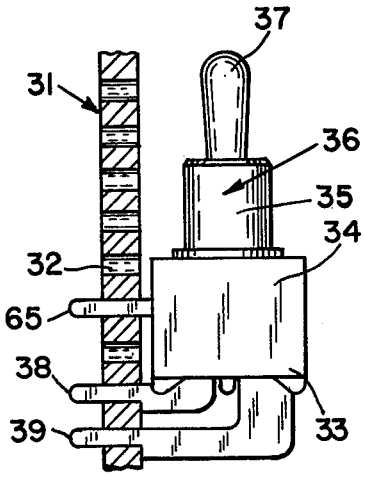
FIG. 2 is an end view in section on line 2—2 of FIG. 1.
Figure 3:
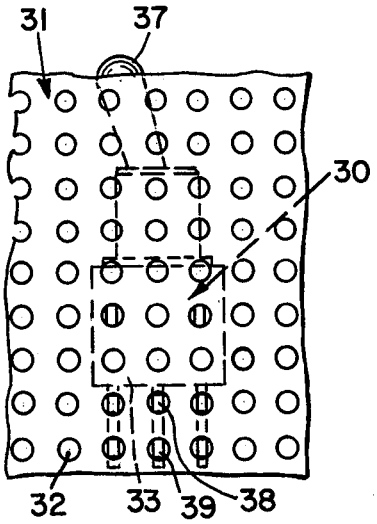
FIG. 3 is a rear view of the board and switch shown in FIG. 1.

The outer portions, 54, 55, 56, 57, 58 and 59 of the six terminals 41, 42, 43, 44, 45 and 46 are angled at ninety degrees to their respective inner portions and each outer portion includes a shoulder 61 and a terminal blade 62 of reduced dimensions, but rectangular cross section, adapted to slidably and firmly enter one of the apertures 32 in the pattern of equally spaced apertures in modular circuit board 31, up to the shoulder 61 as a stop, as shown in FIGS. 1–3.

The flat right angular terminals 41, 42, 43, 44, 45 and 46 also include double shoulders at 63 to secure the same to the exterior of case 33 and are double staked, or upset, at 64 from inside the case, on each opposite side thereof, to anchor them in place, this being a difficult and delicate operation during assembly in view of the space limitations of the sub-miniature size of the components.

Preferably the cover 34 of the frame assembly 36 is also provided with additional integral blades 65 corresponding to, and identical with the conductive blades 62 of the terminals, for also entering the apertures 32 of a board 31 to support the switch 30 thereon.

Insulative tongue and groove means 66 is provided including an insulator member 67, located in the space 68, between the dual rocker contacts 47 and 48. Means 66 includes a pair of spaced apart, upstanding, integral side walls 69 and 71 extending in parallelism with the rockers and at a level well above and well below the contact area of the rockers with the poles of the terminals. The spaced apart, relatively thick walls 69 and 71 jointly define an open, elongated, tongue groove 72 for slidably receiving an elongated tongue 73 with close clearance.

Tongue 73 is integral with, and depends from the center of, an insulated tip 74 of the spring pressed plunger 75 of handle 73, the insulated tip 74 having a pair of rocker contact portions 76 and 77 each for rockably actuating one of the dual rockers 47 or 48.

The tongue and groove means 66 not only forms an insulation barrier between the poles of the double pole switch 30 to prevent arcing therebetween but also assures that the rockers cannot be tilted by the handle tip during actuation to thereby cause uneven opening or closing of the circuits through the switch. By the provision of flat plate, right angularly bent terminals the switch 30 is not only able to be sub-miniature in size but is also enabled to hug closely to the board 31 to conserve space while still being easily operable when required.

Figure 4:
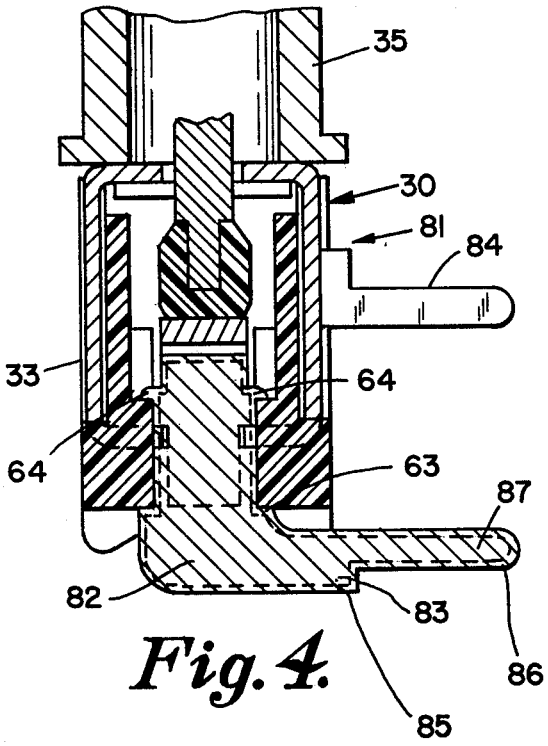
FIG. 4 is an enlarged side elevation, in half section of a single pole switch having the right angular, flat, terminals of the invention.
Figure 8:
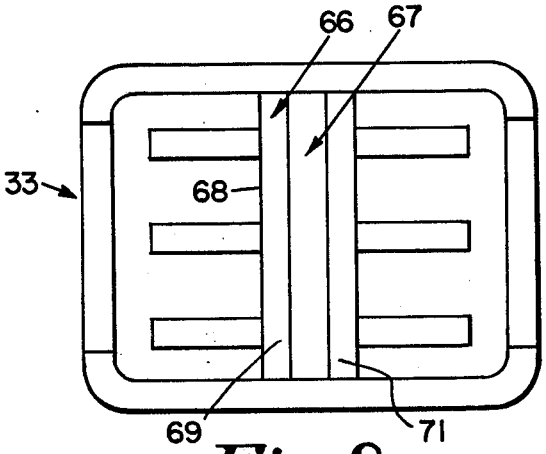
FIG. 8 is a fragmentary plan view of the case prior to assembly and showing the open elongated tongue groove.
Figure 9:
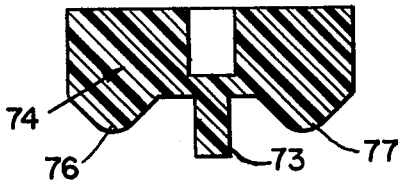
FIG. 9 is a fragmentary side elevation showing the dual contacts, integral tongue and plunger socket for the single spring-pressed plunger of the handle.
Figure 7:
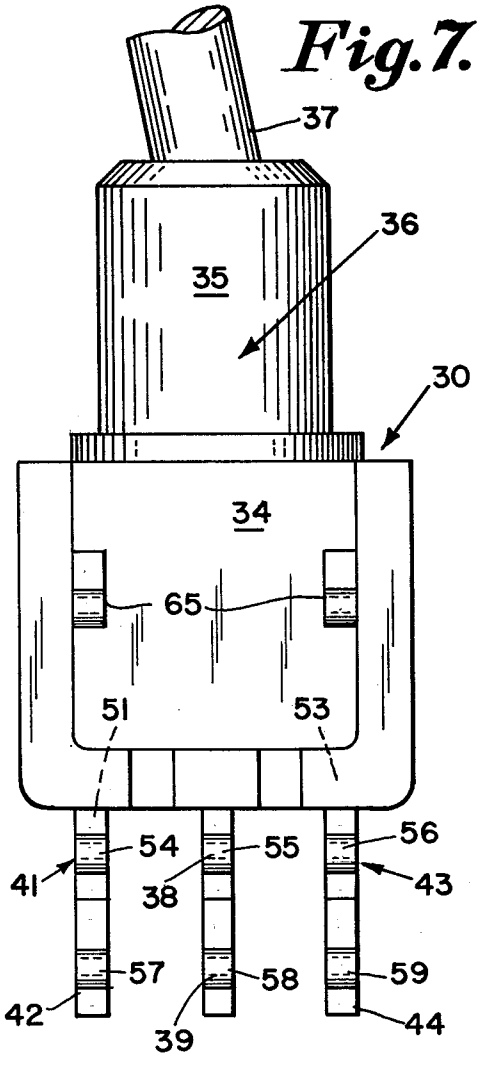
FIG. 7 is a rear elevation on line 7—7 of FIG. 6.
Figure 6:
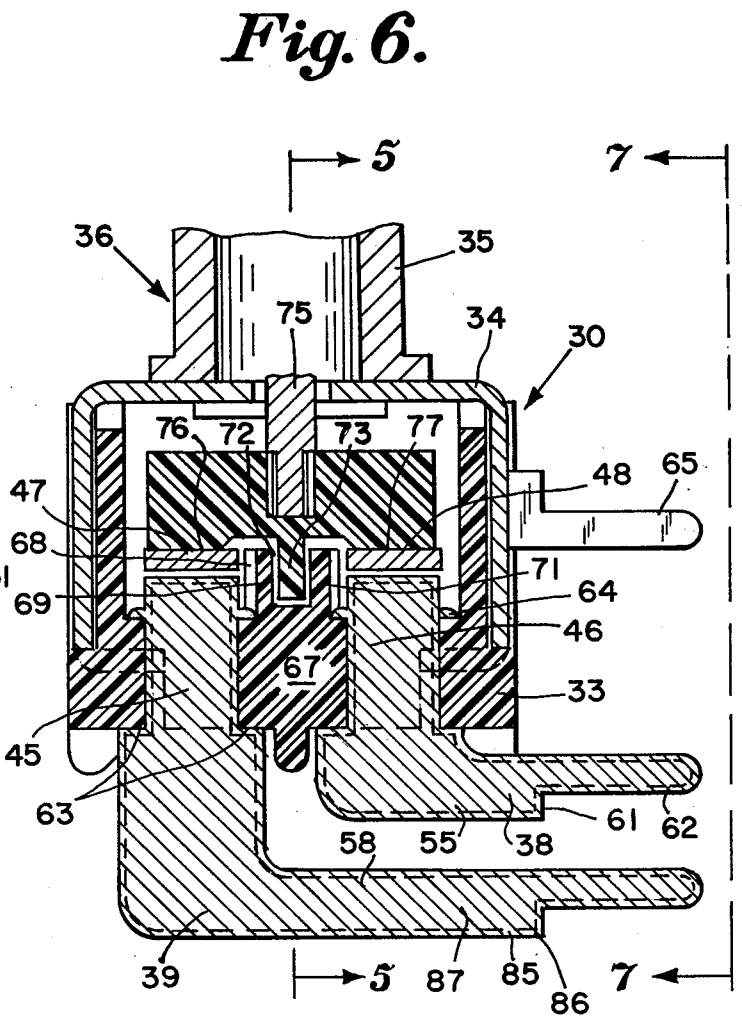
FIG. 6 is a side elevation in section on line 6—6 of FIG. 7.
Figure 5:
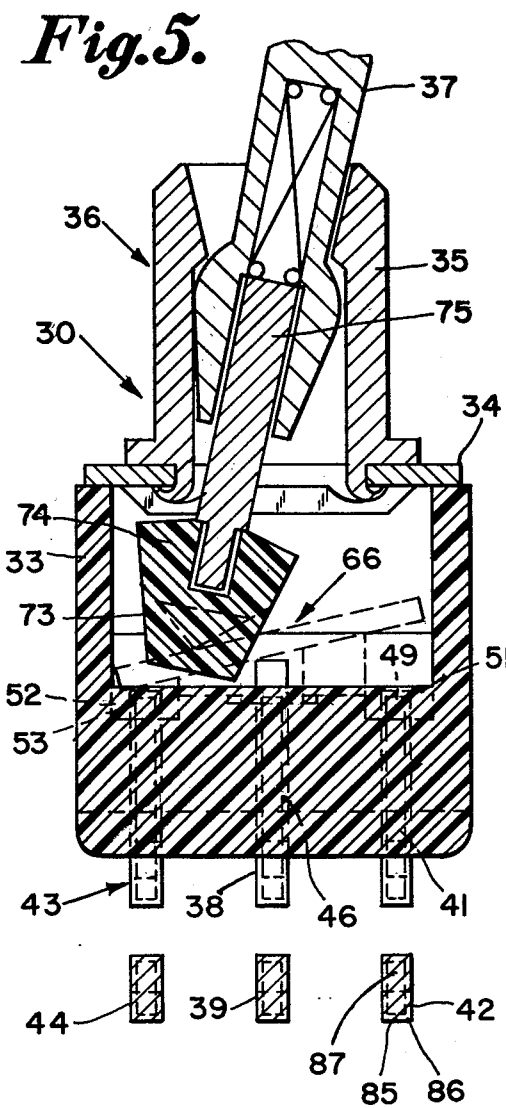
FIG. 5 is a front elevation in section on line 5—5 of FIG. 6 of a double pole two position switch of the invention having both the tongue and groove means and the bent terminals of the invention.

In FIG. 4 a single pole two position switch 81, is shown to demonstrate that even if arcing is not likely in the absence of double poles and dual rockers, the right angular configured terminals 82, and blades 83 and 84 permit the switch to extend in parallelism with a board 31 rather than normal thereto.

When conventional straight rod terminals of non-ferrous alloy metal, or copper, are coated with a nickel coating barrier to prevent the subsequent coat of gold plate from bleeding or migrating and then are bent at right angles to enter apertures of a circuit board, the nickel coating may fracture or crack due to the bending stresses. This not only invites corrosion or oxidation, in the area of the cracked coating but often causes migration of the materials and interference with the contact surfaces and may prevent conductive contact under, low voltage, low current conditions.

Thus the stamping, or pre-forming of the terminals 38, 39, 41, 42, 43 and 44 of copper 87, initially in right angular configuration, then coating with nickel 85 and then with gold plate 86, assures that there will be no cracks in the coatings to cause such unwanted corrosion, oxidation, bleeding or migration of materials.

I claim:

1. A sub-miniature, two position, double pole switch of the type having a case with six projecting conductive terminals, a pair of spaced rockers and a handle with a spring pressed plunger and insulated tip for actuating the rockers characterized by:

an insulator member in the space between said rockers, within said case, said member having an elongated tongue groove extending in parallelism with said rockers and, an elongated integral tongue on the insulated tip of said plunger, said tongue being slidably received in said tongue groove of said member during actuation of said rockers to prevent twisting of said rockers and uneven closing of the circuits to said terminals, said insulator member forming a barrier between said double pole terminals and said rockers to prevent arcing therebetween.

2. A switch as specified in claim 1 wherein:

said six projecting conductive terminals are each formed of flat thin plate-like metal of generally rectangular cross section, said terminal having inner portions within said case with certain terminal tips in the path of said rockers and having outer portions outside said case, angled at right angles to said inner portions and having terminal blades adapted to be received in the apertures of an apertured, modular printed circuit board.

3. A switch as specified in claim 2 wherein:

said case includes a plurality of additional said blades, affixed to the exterior of said case and adapted to be received in the apertures of said apertured, modular printed circuit board.

4. A switch as specified in claim 2 wherein:

each said terminal includes a shoulder in the outer portions thereof for serving as a stop when said blades are inserted in the apertures of said board.

5. In a two position, double pole, switch having a pair of spaced rockers, a pair of central terminals forming the fulcrum of said rockers, two pairs of outer terminals in the path of the ends of said rockers and a switch handle with spring pressed plunger and insulated tip member for jointly actuating said rockers, the combination of:

outer, integral portions of said terminals, angled at about ninety degrees to the inner portions thereof, within said case;

each said outer portion being of flattened configuration of generally rectangular cross section and having a terminal blade of reduced rectangular cross section defined by a shoulder, for insertion in the circular apertures of a modular printed circuit board, an insulator member in the space between said rockers within said casing, and insulative tongue and tongue groove means operably connecting said insulated tip member and said insulator member and extending in parallelism with the said rockers for preventing twisting of said rockers and consequent uneven closing of the circuits through said rockers and terminals, while also preventing arcing within said switch.

6. In a two position, double pole, double rocker, single plunger, switch the combination of:

six switch terminals each of flat, thin, rectangular cross section with inner portions, within said switch, operably associated with said rockers and with integral outer portions angled at about ninety degrees from said inner portions and terminating in blades adapted to slidably fit spaced circular apertures in a modular printed circuit board, and insulative tongue and groove means between and extending in parallelism with said double rockers for preventing twisting thereof during rocking movement and preventing arcing between the poles of said double poles.

7. A switch as specified in claim 6 wherein:

said tongue and groove means comprises an elongated tongue depending centrally from the plunger of said switch and, an insulated member fixed between said double rockers and having an elongated tongue groove, slidably receiving said tongue.

8. A swtich as specified in claim 7 wherein:

said tongue is of insulative material and of predetermined dimensions and said insulated member includes side walls of insulative material and of predetermined dimensions forming said tongue groove therebetween, said tongue and groove substantially overlapping each other to form a barrier to arcing within said switch and between said rockers.

9. A switch as specified in claim 6 wherein:

said insulative tongue and groove means includes an insulative member having side walls of predetermined thickness and height for defining said tongue groove therebetween, said side walls extending above and below the level of the inner portions of said terminals which are in the path of contact of said rockers to form a barrier to any arcing between said dual rockers and between said terminals.

10. A switch as specified in claim 6 wherein:

said insulative tongue and groove means is positioned at the level of the portions of said rocker and terminals which become conductive upon actuation of said switch, to thereby form a barrier to cross arcing between said dual rockers.

* * * * *